US011087667B2

(12) United States Patent
Guo et al.

(10) Patent No.: US 11,087,667 B2
(45) Date of Patent: Aug. 10, 2021

(54) PIXEL CHARGING METHOD, CIRCUIT, DISPLAY DEVICE AND COMPUTER STORAGE MEDIUM

(71) Applicants: BOE Technology Group Co., Ltd., Beijing (CN); Beijing BOE Display Technology Co., Ltd., Beijing (CN)

(72) Inventors: Luqiang Guo, Beijing (CN); Xue Dong, Beijing (CN); Ming Chen, Beijing (CN); Shou Li, Beijing (CN); Xin Duan, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 660 days.

(21) Appl. No.: 16/062,428

(22) PCT Filed: Dec. 14, 2017

(86) PCT No.: PCT/CN2017/116260

§ 371 (c)(1),
(2) Date: Jun. 14, 2018

(87) PCT Pub. No.: WO2018/176917

PCT Pub. Date: Oct. 4, 2018

(65) Prior Publication Data

US 2021/0166608 A1 Jun. 3, 2021

(30) Foreign Application Priority Data

Mar. 30, 2017 (CN) ..... 201710203968.8

(51) Int. Cl.
*G09G 3/20* (2006.01)

(52) U.S. Cl.
CPC ..... *G09G 3/2074* (2013.01); *G09G 2310/027* (2013.01); *G09G 2310/08* (2013.01)

(58) Field of Classification Search
CPC ..... G09G 3/2074; G09G 2310/08; G09G 2310/027
See application file for complete search history.

(56) References Cited

U.S. PATENT DOCUMENTS

2009/0109158 A1* 4/2009 Shirai ..... G09G 3/3688 345/94
2010/0309394 A1* 12/2010 Numao ..... G09G 3/3655 348/792

(Continued)

FOREIGN PATENT DOCUMENTS

CN 103021352 4/2013
CN 104751767 7/2015

(Continued)

OTHER PUBLICATIONS

International Search Report for PCT Application No. PCT/CN2017/116260 dated Mar. 13, 2018.

(Continued)

*Primary Examiner* — Andrew Sasinowski
(74) *Attorney, Agent, or Firm* — Fay Sharpe LLP

(57) ABSTRACT

There are provided a pixel charging method, a circuit, a display device and a computer storage medium. The method includes: acquiring a gray-scale value of each row of sub-pixels in an image frame of an image to be displayed; determining a charging time of each row of the sub-pixels according to the gray-scale value thereof; and charging each row of the sub-pixels according to the charging time thereof when a display panel displays the image frame. The charging time of each row of sub-pixels is determined according to the gray-scale value of each row of the sub-pixels, so as to reduce a charging rate difference between two rows of (Continued)

sub-pixels which have a relatively larger gray-scale value difference therebetween, and achieve an effect of improving the uniformity of the charging rates of all rows of sub-pixels in the display panel.

20 Claims, 5 Drawing Sheets

(56) References Cited

U.S. PATENT DOCUMENTS

| | | | | |
|---|---|---|---|---|
| 2012/0179923 | A1* | 7/2012 | Sasaki | G09G 3/3659<br>713/300 |
| 2018/0174531 | A1* | 6/2018 | Chen | G09G 3/3674 |
| 2020/0152150 | A1* | 5/2020 | Huang | G09G 3/3696 |

FOREIGN PATENT DOCUMENTS

| | | |
|---|---|---|
| CN | 105895040 | 8/2016 |
| CN | 106205558 | 12/2016 |
| CN | 106526998 | 3/2017 |
| CN | 107068086 | 8/2017 |
| KR | 20160025141 | 3/2016 |

OTHER PUBLICATIONS

Chinese Office Action for Chinese Application No. 201710203968.8 dated May 30, 2018.

* cited by examiner

PIXEL CHARGING METHOD, CIRCUIT, DISPLAY DEVICE AND COMPUTER STORAGE MEDIUM

This application is a 371 of PCT Patent Application Serial No. PCT/CN2017/116260 filed Dec. 14, 2017, which claims priority to Chinese Patent Application No. 201710203968.8, filed with the State Intellectual Property Office of China on Mar. 30, 2017 and titled "Pixel Charging Method and Circuit", the entire contents of which are incorporated herein by reference.

TECHNICAL FIELD

The present disclosure relates to a pixel charging method, a circuit, a display device and a computer storage medium.

BACKGROUND

When a display panel displays, a control integrated circuit (IC) in the display panel writes a data voltage into each sub-pixel. The data voltage is used to control each sub-pixel to display.

There is a pixel charging method in the related art. In this method, a control IC writes a data voltage into each row of sub-pixels in a display panel, so as to charge each row of sub-pixels. A charging time is determined according to a size and a refresh frequency of the display panel. When the size and the refresh frequency of the display panel are fixed, the charging time of all rows of the sub-pixels in the display panel is the same.

SUMMARY

There are provided a pixel charging method, a circuit, a display device and a computer storage medium in embodiments of the present disclosure.

According to a first aspect of the present disclosure, there is provided a pixel charging method, including:

acquiring a gray-scale value of each row of sub-pixels in an image frame to be displayed;

determining a charging time of each row of the sub-pixels according to the gray-scale value of each row of the sub-pixels, wherein a charging time of an n-th row of the sub-pixels in the image frame is positively related to an absolute value of a difference value, the difference value is a difference value between a gray-scale value of the n-th row of the sub-pixels and a gray-scale value of an (n−1)-th row of the sub-pixels in the image frame, and n is an integer greater than 1; and charging each row of the sub-pixels according to the charging time of each row of the sub-pixels when a display panel displays the image frame.

Optionally, the charging time of each row of the sub-pixels includes an active data transmission time for writing active data into each row of the sub-pixels and a blank time for writing blank data into each row of the sub-pixels.

Optionally, the determining of the charging time of each row of the sub-pixels according to the gray-scale value of each row of the sub-pixels includes: determining a blank time of each row of the sub-pixels according to the gray-scale value of each row of the sub-pixels; and acquiring an active data transmission time of each row of the sub-pixels, the active data transmission time being determined based on a size and a refresh frequency of the display panel.

Optionally, the charging of each row of the sub-pixels according to the charging time of each row of the sub-pixels when the display panel displays the image frame includes: charging each row of the sub-pixels according to the blank time and the active data transmission time of each row of the sub-pixels when the display panel displays the image frame.

Optionally, the determining of the blank time of each row of the sub-pixels according to the gray-scale value of each row of the sub-pixels includes: acquiring an absolute value of the difference value;

determining a weight value of the n-th row of the sub-pixels according to the absolute value of the difference value, the weight value being positively related to the absolute value of the difference value; and determining a product of the weight value and a standard length of the blank time to be a blank time of the n-th row of the sub-pixels, the standard length of the blank time being determined based on the size and the refresh frequency of the display panel.

Optionally, the determining of the weight value of the n-th row of the sub-pixels according to the absolute value of the difference value includes: acquiring an average gray-scale difference value according to a equation, and the equation is shown as $$P = \left(\sum_{i=2}^{h} \Delta L_i\right) \Big/ (h-1),$$

wherein $\Delta L_i$ represents an absolute value of a difference value between a gray-scale value of an i-th row of the sub-pixels and a gray-scale value of an (i−1)-th row of the sub-pixels, h represents a total number of rows of the sub-pixels in the display panel, P represents the average gray-scale difference value, and i may be any number greater than or equal to 2 and less than or equal to h; and determining a quotient of the absolute value of the difference value and the average gray-scale difference value to be the weight value of the n-th row of the sub-pixels.

Optionally, in the image frame, a gray-scale value of a row of sub-pixels is an average value of gray-scale values of all sub-pixels in the row of the sub-pixels.

According to a second aspect of the present disclosure, there is provided a pixel charging circuit, including:

a gray-scale acquisition sub-circuit, configured to acquire a gray-scale value of each row of sub-pixels in an image frame;

a time determination sub-circuit, configured to determine a charging time of each row of the sub-pixels according to the gray-scale value of each row of the sub-pixels, wherein a charging time of an n-th row of the sub-pixels in the image frame is positively related to an absolute value of a difference value, and the difference value is a difference value between a gray-scale value of the n-th row of the sub-pixels and a gray-scale value of an (n−)-th row of the sub-pixels in the image frame, and n is an integer greater than 1; and a pixel charging sub-circuit, configured to charge each row of the sub-pixels according to the charging time of each row of the sub-pixels when a display panel displays the image frame.

Optionally, the charging time of each row of the sub-pixels includes an active data transmission time for writing active data into each row of the sub-pixels and a blank time for writing blank data into each row of the sub-pixels.

Optionally, the time determination sub-circuit includes:
a blank time determination sub-circuit, configured to determine the blank time of each row of the sub-pixels according to the gray-scale value of each row of the sub-pixels; and
an active time determination sub-circuit, configured to acquire the active data transmission time of each row of the sub-pixels, the active data transmission time being determined based on a size and a refresh frequency of the display panel.

Optionally, the pixel charging sub-circuit is configured to charge each row of the sub-pixels according to the blank time and the active data transmission time of each row of the sub-pixels when the display panel displays the image frame.

Optionally, the blank time determination sub-circuit includes:
an absolute value determination sub-circuit, configured to acquire an absolute value of the difference value:
a weight value determination sub-circuit, configured to determine a weight value of the n-th row of sub-pixels according to the absolute value of the difference value, the weight value being positively related to the absolute value of the difference value; and a length determination sub-circuit, configured to determine a product of the weight value and a standard length of the blank time to be a blank time of the n-th row of sub-pixels, the standard length of the blank time being determined based on the size and the refresh frequency of the display panel.

Optionally, the weight value determination sub-circuit is configured to: acquire an average gray-scale difference value according to a equation, and the equation is shown as $$P = \left(\sum_{i=2}^{h} \Delta L_i\right) \Big/ (h-1),$$

wherein $\Delta L_i$ represents an absolute value of a difference value between a gray-scale value of an i-th row of the sub-pixels and a gray-scale value of an (i−1)-th row of the sub-pixels, h represents a total number of rows of the sub-pixels in the display panel, P represents the average gray-scale difference value, and i may be any number greater than or equal to 2 and less than or equal to h; and
determine a quotient of the absolute value of the difference value and the average gray-scale difference value to be the weight value of the n-th row of the sub-pixels.

Optionally, in the image frame, a gray-scale value of a row of sub-pixels is an average value of gray-scale values of all sub-pixels in the row of the sub-pixels.

In a third aspect, there is provided a display device, including the pixel charging circuit of the second aspect.

In a fourth aspect, there is provided a display panel driving device, including: a memory, configured to store program instructions; and
a processor configured to invoke the program instructions stored in the memory and execute the method of the first aspect according to the obtained program instructions.

In a fifth aspect, there is provided a computer storage medium storing computer-executable instructions which cause a computer to execute the method of the first aspect.

DETAILED DESCRIPTION

Implementations of the present disclosure will be described in further detail with reference to the accompanying drawings, to clearly present the principles and advantages of the present disclosure. These accompanying drawings and descriptions are not intended to limit the scope of the present disclosure in any manner, but to explain the concept of the present disclosure to those skilled in the art with reference to specific embodiments.

Figure 1:
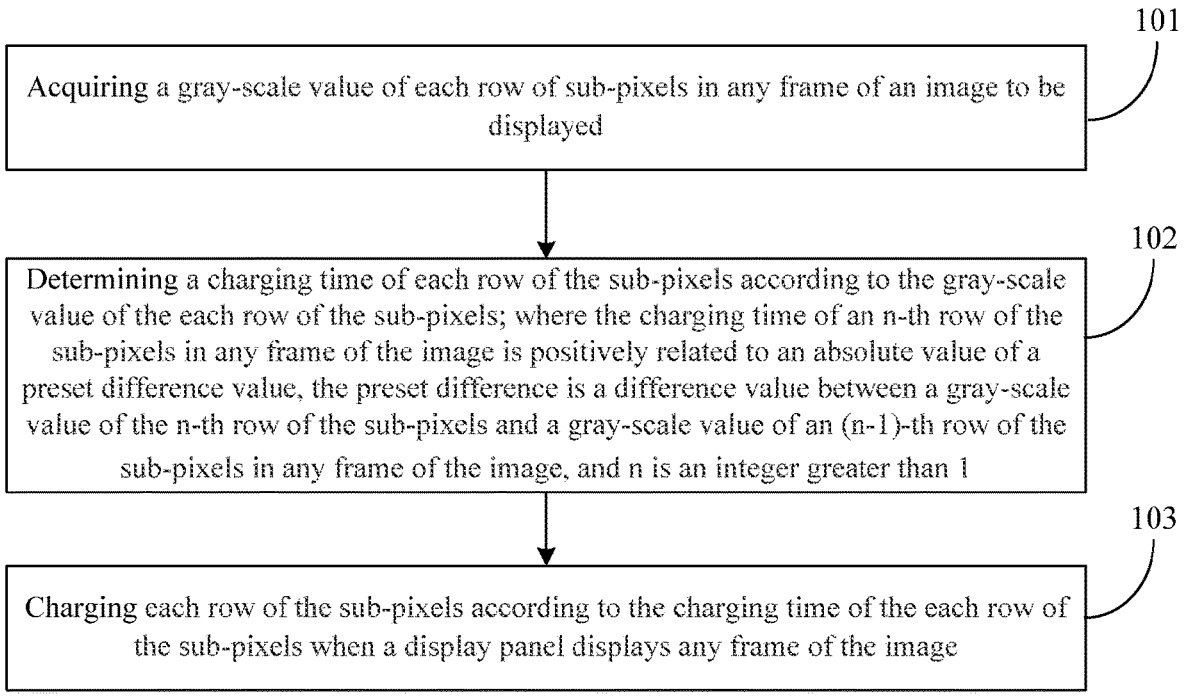
FIG. 1 is a flowchart of a pixel charging method illustrated by an embodiment of the present disclosure.

FIG. 1 is a flowchart of a pixel charging method illustrated by an embodiment of the present disclosure. The pixel charging method may include the following steps:
acquiring a gray-scale value of each row of sub-pixels in any frame of an image to be displayed in step 101;
determining a charging time of each row of the sub-pixels according to the gray-scale value of each row of the sub-pixels in step 102; where the charging time of an n-th row of the sub-pixels in any frame of the image is positively related to an absolute value of a preset difference value, the preset difference is a difference value between a gray-scale value of the n-th row of the sub-pixels and a gray-scale value of an (n−1)-th row of the sub-pixels in any frame of the image, and n is an integer greater than 1; and charging each row of the sub-pixels according to the charging time of each row of the sub-pixels when a display panel displays any frame of the image in step 103.

In summary, in the pixel charging method provided by an embodiment of the present disclosure, the charging time of each row of sub-pixels is determined according to the gray-scale value of each row of the sub-pixels, so as to reduce a charging rate difference between two rows of sub-pixels which have a relatively larger gray-scale value difference therebetween, solve a problem of un-uniform charging rates of all rows of the sub-pixels in the related art, and achieve an effect of improving the uniformity of the charging rates of all rows of sub-pixels in the display panel.

Figure 2A:
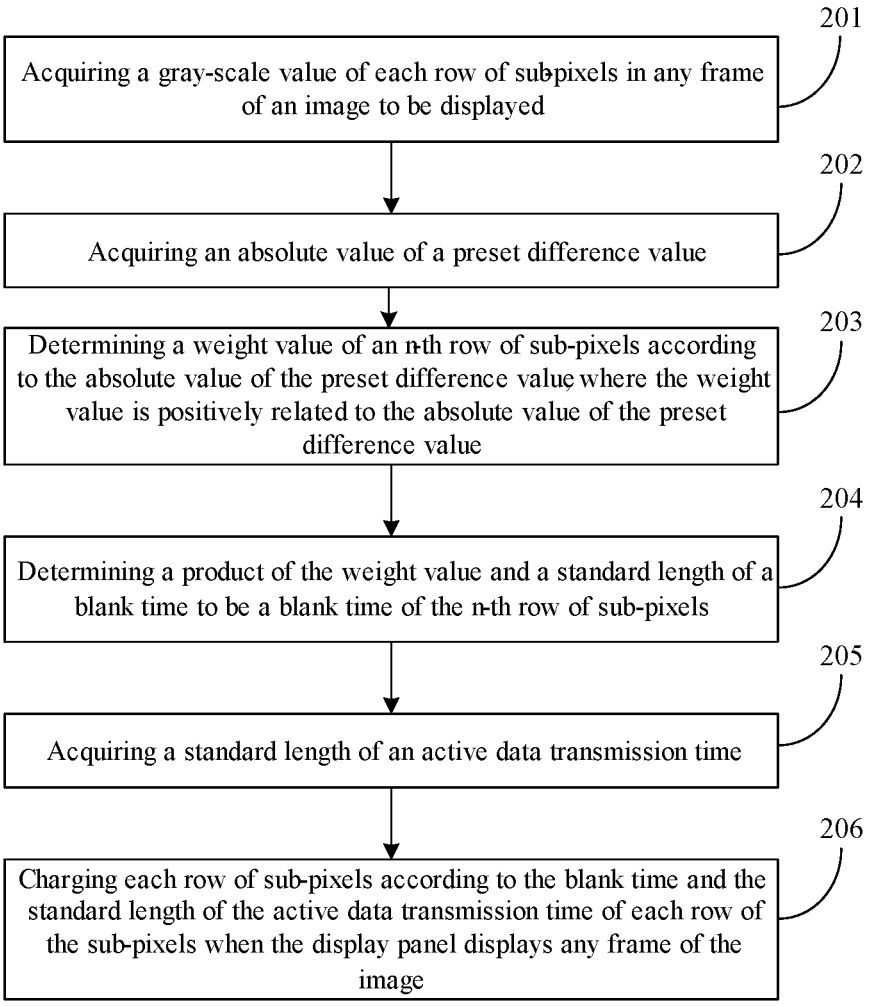
FIG. 2A is a flowchart of another pixel charging method illustrated by an embodiment of the present disclosure.

FIG. 2A is a flow chart of another pixel charging method illustrated by an embodiment of the present disclosure. The pixel charging method may include the following steps:
acquiring a gray-scale value of each row of sub-pixels in any frame of an image to be displayed in step 201.

The pixel charging method provided by an embodiment of the present disclosure may be implemented by a pixel charging circuit. The pixel charging circuit may be integrated in a control IC of a display panel.

When the display panel displays, the control IC may acquire the image to be displayed from a front end (the front end may be a device for inputting image data to the display panel, such as a display card or a graphics processing unit (GPU)). In this step, the image to be displayed may include multiple frames of images. Each frame of the image may be composed of multiple rows of sub-pixels. The pixel charging circuit may acquire the gray-scale value of each row of sub-pixels in any frame of the image according to these frames of images to be displayed. Herein, the gray-scale value of any row of the sub-pixels may be an average value of gray-scale values of all the sub-pixels in this row of the sub-pixels. A gray-scale value is a numerical value for identifying a brightness level of a sub-pixel.

The pixel charging method shown in FIG. 2 may further include the following step: acquiring an absolute value of a preset difference value in step 202.

The pixel charging circuit may acquire a difference value between a gray-scale value of an n-th row of sub-pixels and a gray-scale value of an (n−1)-th row of the sub-pixels according to the gray-scale value of each row of the sub-pixels acquired in step 201. The preset difference value may serve as a preset different value corresponding to the n-th row of the sub-pixels, and n is an integer greater than 1.

The pixel charging method shown in FIG. 2 may further include the following step: determining a weight value of an n-th row of sub-pixels according to the absolute value of the preset difference value in step 203, where the weight value is positively related to the absolute value of the preset difference value.

The pixel charging circuit may determine the weight value of the n-th row of sub-pixels according to an absolute value of the difference value (namely, the preset difference value) between the gray-scale value of the n-th row of sub-pixels and the gray-scale value of the (n−1)-th row of sub-pixels. The weight value is positively related to the absolute value of the preset difference value.

The larger the absolute value (the absolute value of the preset difference value is configured to indicate the difference between the gray-scale value of the n-th row of sub-pixels and the gray-scale value of the (n−1)-th row of sub-pixels, since the gray-scale value of the n-th row of sub-pixels may be more than or less than the gray-scale value of the (n−1)-th row of sub-pixels) of the preset difference value is, the larger the difference value between a deflection angle of liquid crystal in the n-th row of sub-pixels and a deflection angle of liquid crystal in the (n−)-th row of sub-pixels is, and the larger the voltage swing of a driver (which may be located in the pixel charging circuit) for charging the sub-pixels is. Tus, a charging time of the n-th row of sub-pixels can be lengthened to enable a charging rate of the n-th row of sub-pixels to be more consistent to a charging rate of the (n−1)-th row of sub-pixels. In the case of a large difference value between deflection angles of liquid crystal in two adjacent rows of sub-pixels, if the charging time of the two adjacent rows of sub-pixels is the same, charging rates of the two adjacent rows of sub-pixels are different, resulting in a problem of a relatively poor display effect of the display panel, which is particularly serious when a size of the display panel is larger or a resolution of the display panel is higher. Therefore, the pixel charging circuit may adjust the weight value of the n-th row of sub-pixels according to the preset difference value and may further adjust the charging time of the n-th row of sub-pixels, so as to enable the charging rates of both the n-th row of sub-pixels and the (n−1)-th row of sub-pixels to be more consistent.

Thus, the pixel charging method provided by an embodiment of the present disclosure can be applied to a display panel with a larger size and a higher resolution. Herein, the charging rate can be understood as a charging level of a sub-pixel.

Figure 2B:
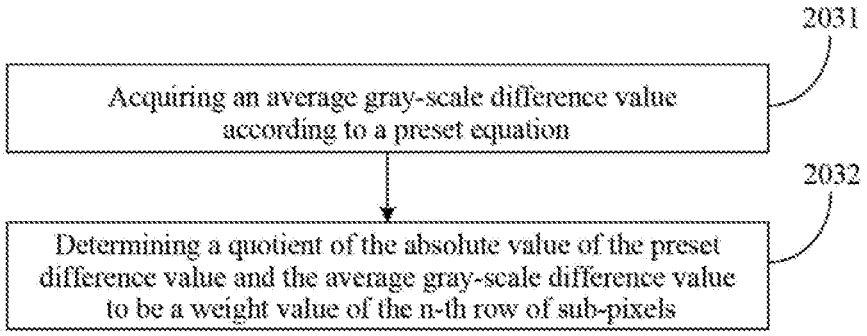
FIG. 2B is a flowchart of determining a weight value in an embodiment illustrated by FIG. 2A.

FIG. 2B is a flowchart of determining a weight value in an embodiment illustrated by FIG. 2A. As shown in FIG. 2B, step 203 includes the following sub-step:

acquiring an average gray-scale difference value according to a preset equation in sub-step 2031.

The preset equation may be $$P = \left(\sum_{i=2}^{h} \Delta L_i\right) \Big/ (h-1),$$

where $\Delta L_i$ represents an absolute value of a difference value between a gray-scale value of an i-th row of sub-pixels and a gray-scale value of a (i−1)-th row of sub-pixels; h represents a total number of rows of sub-pixels in the display panel, and h is greater than or equal to n; P represents an average gray-scale difference value; and i may be any number greater than or equal to 2 and less than or equal to h.

The pixel charging circuit may acquire the average gray-scale difference value according to the preset equation. The average gray-scale difference value is an average difference value of gray-scale values of every two adjacent rows of sub-pixels in any frame of the image. That is, any frame of the image to be displayed corresponds to an average gray-scale difference value. Herein, h−1 means that the total number of absolute values of difference values is h−1 when gray-scale values of every two adjacent sub-pixels in h rows of sub-pixel are subtracted.

Exemplarily, the display panel includes 2160 rows of sub-pixels, 3840 columns of sub-pixels. Thus, h=2160, and $$P = \left(\sum_{i=2}^{2160} \Delta L_i\right) \Big/ 2159.$$

The step 203 further includes the following step: determining a quotient of the absolute value of the preset difference value and the average gray-scale difference value to be a weight value of the n-th row of sub-pixels in sub-step 2032.

The pixel charging circuit may determine the quotient of the absolute value of the preset difference value and the average gray-scale difference value to be the weight value of the n-th row of sub-pixels. That is, the weight value of the n-th row of sub-pixels is $K(n)=\Delta L_n/P$, where $\Delta L_n$ represents an absolute value of a difference value between the gray-scale value of the n-th row of sub-pixels and the gray-scale value of the (n−1)-th row of sub-pixels; and P represents an average gray-scale difference value.

The pixel charging method shown in FIG. 2 may further include the following step: determining a product of the weight value and a standard length of a blank time to be a blank time of the n-th row of sub-pixels in step 204.

The charging time of each row of sub-pixels may include an active data transmission time for writing active data into each row of sub-pixels and a blank time for writing blank data into each row of sub-pixels. Both a standard length of the blank time and a standard length of the active data transmission time may be determined based on a size and a refresh frequency of the display panel, and may be sent from a control terminal of the display panel to the pixel charging circuit. A manner for determining the standard lengths of both the blank time and the active data transmission time may refer to the related art, and is not repeated herein.

Figure 2C:
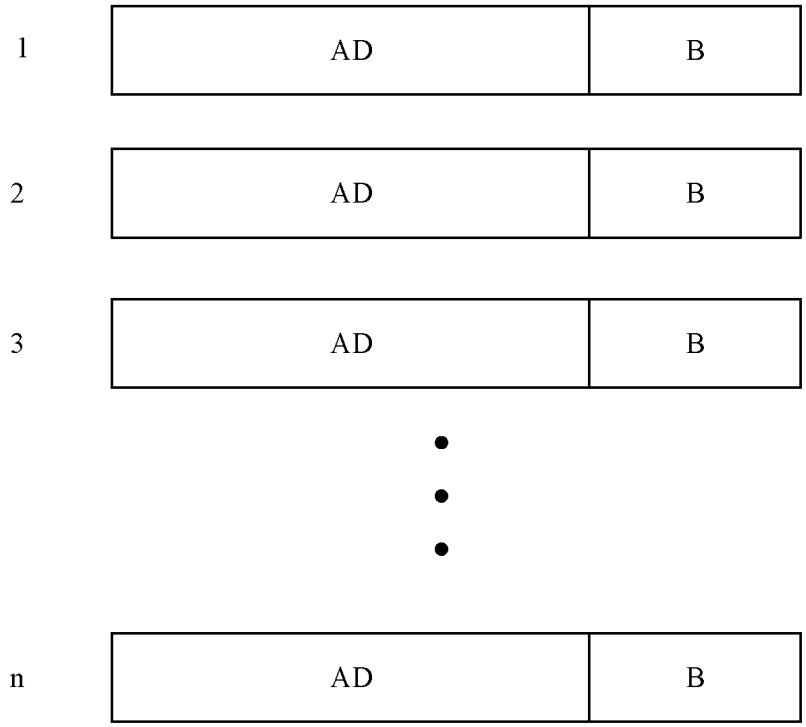
FIG. 2C is a schematic view of a charging time of pixels in the related art.

In the related art, the charging time of each row of sub-pixels is generally the same. FIG. 2C shows a schematic view of a charging time of each row of sub-pixels in a frame of an image in the related art, where a horizontal length of an AD box indicates an active data transmission time; a horizontal length of a B box indicates a blank time; and a figure at the left side of a combination box of the AD box and the B box in the same row represents a row number of sub-pixels. It can be seen that in FIG. 2C, the horizontal lengths of boxes corresponding to each row of sub-pixels are the same. That is, the charging time of all rows of sub-pixels is the same.

Figure 2D:
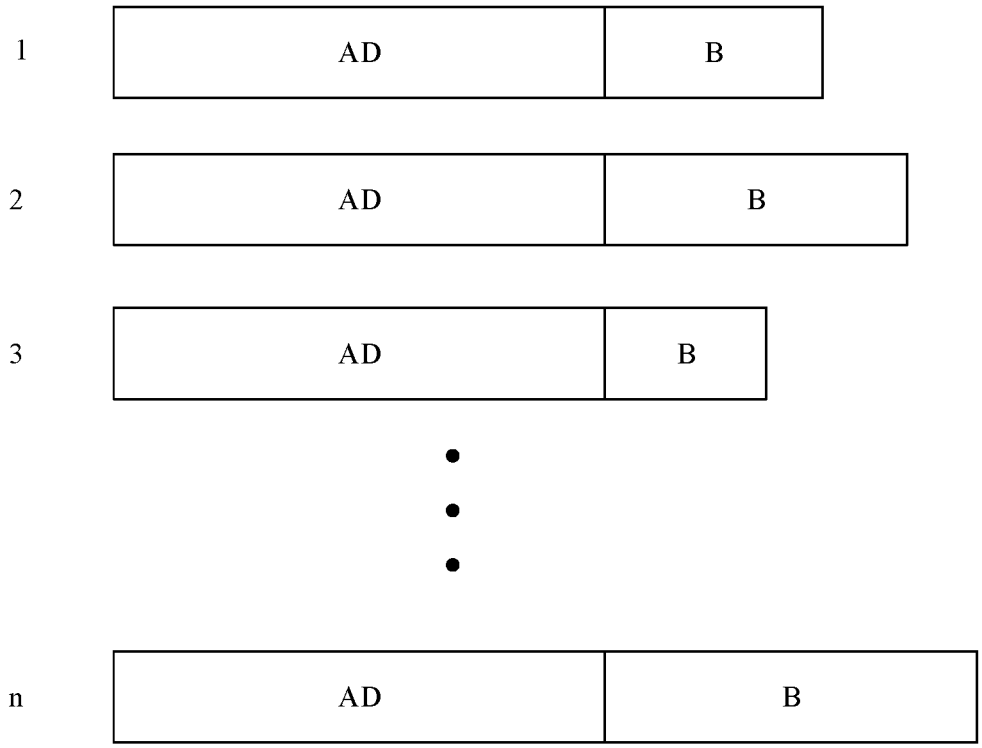
FIG. 2D is a schematic view of a charging time of pixels in an embodiment of the present disclosure.

In an embodiment of the present disclosure, the pixel charging circuit adjusts the blank time of each row of sub-pixels according to the weight value, so as to meet different requirements of different rows of sub-pixels on charging time, thereby improving the uniformity of charging rates of each row of sub-pixels in the display panel. Exemplarily, FIG. 2D shows a schematic view of a charging time of each row of sub-pixels of a frame of an image through a pixel charging circuit according to an embodiment of the present disclosure. It can be seen that the blank time of different rows of sub-pixels may be different, and thus, the charging time of different rows of sub-pixels may also be different. In a case, an absolute value of a preset difference value corresponding to the second row of sub-pixels (which is a difference value between the gray-scale value of the second row of sub-pixels and the gray-scale value of the first row of sub-pixels) may be greater than an absolute value of a preset difference value corresponding to the third row of sub-pixels (which is a difference value between the gray-scale value of the third row of sub-pixels and the gray-scale value of the second row of sub-pixels). As can be seen from the above, the blank time of the second row of sub-pixels is longer than the blank time of the third row of sub-pixels. The reference numerals in FIG. 2D may refer to those in FIG. 2C, and are not repeated herein.

Herein, it should be noted that, due to the difficulty in adjusting the transmission time of active data (namely, the active data transmission time), the charging time is adjusted by adjusting the blank time in the embodiment of the present disclosure, thereby reducing the difficulty in adjusting the charging time.

The steps 202-204 are the steps that determine a blank time of the n-th row of sub-pixels according to the gray-scale value of each row of sub-pixels. The pixel charging circuit may determine a blank time of each row of sub-pixels in any frame of the image according to steps 202-204. Afterwards, the pixel charging circuit can acquire an active data transmission time of each row of sub-pixels, and charge each row of sub-pixels according to the blank time and the active data transmission time of each row of sub-pixels when the display panel displays any frame of the image. The active data transmission time is determined based on the size and the refresh frequency of the display panel. Optionally, the active data transmission time of all rows of sub-pixels may be the same, that is, the active data transmission time of each row of sub-pixels is a standard length. The following embodiments of the present disclosure are described with an active data transmission time of each row of sub-pixels being a standard length. However, the active data transmission time of each row of sub-pixels may have other lengths, which is not limited by the present disclosure.

The pixel charging method shown in FIG. 2 may further include the following step: acquiring a standard length of an active data transmission time in step 205.

The standard length of the active data transmission time may be determined based on the size and the refresh frequency of the display panel. The pixel charging circuit may acquire the standard length from a control terminal of the display panel.

After the pixel charging circuit acquires the standard length of the active data transmission time and the blank time, a charging time can be acquired by adding the standard length of the active data transmission time and the blank time.

The pixel charging method shown in FIG. 2 may further include the following step: charging each row of sub-pixels according to the blank time and the standard length of the active data transmission time of each row of the sub-pixels when the display panel displays any frame of the image in step 206.

After acquiring a charging time of each row of the sub-pixels in any frame of the image, the pixel charging circuit may charge each row of the sub-pixels according to the blank time and the standard length of the active data transmission time of each row of the sub-pixels when the display panel displays any frame of the image. That is, when any row of sub-pixels in any frame of the image is charged, the active data may be transmitted according to the standard length of the active data transmission time acquired in step 205, and the blank data may be transmitted according to the blank length acquired in step 204.

When the display panel displays each frame of the image to be displayed, the pixel charging circuit may charge each row of the sub-pixels through the manners provided in steps 201-206.

In summary, in the pixel charging method provided by an embodiment of the present disclosure, the charging time of each row of sub-pixels is determined according to the gray-scale value of each row of the sub-pixels, so as to reduce a charging rate difference between two rows of sub-pixels which have a relatively larger gray-scale value difference therebetween, solve a problem of un-uniform charging rates of all rows of the sub-pixels in the related art, and achieve an effect of improving the uniformity of the charging rates of all rows of sub-pixels in the display panel.

A device embodiment provided by the present disclosure is described below, which may be used to implement a method embodiment provided by the present disclosure. Details not disclosed in the device embodiment of the present disclosure may refer to the method embodiment of the present disclosure.

Figure 3A:
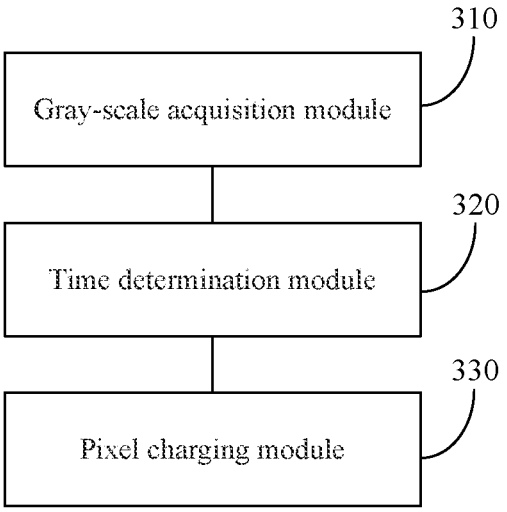
FIG. 3A is a block diagram of a pixel charging circuit illustrated by an embodiment of the present disclosure.

FIG. 3A is a block diagram of a pixel charging circuit illustrated by an embodiment of the present disclosure. The pixel charging circuit may be implemented as part or all of a control IC through software, hardware or a combination thereof. The pixel charging circuit may include:

a gray-scale acquisition sub-circuit 310 configured to acquire a gray-scale value of each row of sub-pixels in any frame of an image; where the gray-scale acquisition sub-circuit 310 may execute step 101 in the above embodiment;

a time determination sub-circuit 320 configured to determine a charging time of each row of the sub-pixels according to the gray-scale value of each row of the sub-pixels, where a charging time of an n-th row of sub-pixels in any frame of the image is positively related to an absolute value of a preset difference value, the preset difference is a difference value between a gray-scale value of the n-th row of sub-pixels and a gray-scale value of an (n−1)-th row of the sub-pixels in any frame of the image, and n is an integer greater than 1; wherein the time determination sub-circuit 320 may execute step 102 in the above embodiment; and a pixel charging sub-circuit 330 configured to charge each row of the sub-pixels according to the charging time of each row of the sub-pixels when a display panel displays any frame of the image; where the pixel charging sub-circuit 330 may execute step 103 in the above embodiment.

Optionally, the charging time of each row of the sub-pixels includes an active data transmission time for writing active data into each row of the sub-pixels and a blank time for writing blank data into each row of the sub-pixels.

Figure 3B:
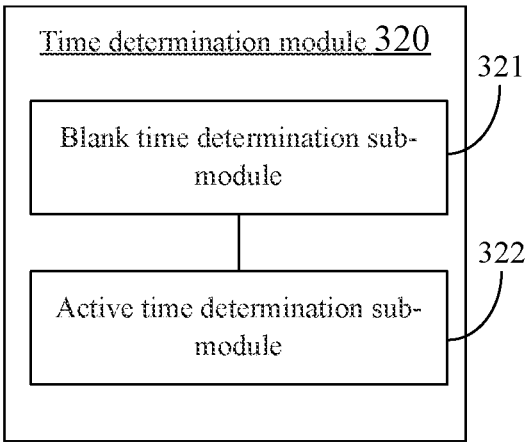
FIG. 3B is a block diagram of a time determination sub-circuit in the embodiment illustrated by FIG. 3A.

FIG. 3B is a block diagram of a time determination sub-circuit in the embodiment illustrated by FIG. 3A. As shown in FIG. 3B, the time determination sub-circuit 320 includes:

a blank time determination sub-circuit 321 configured to determine a blank time of each row of the sub-pixels according to the gray-scale value of each row of the sub-pixels; where the blank time determination sub-circuit 321 may execute steps 202 to 204 in the above embodiment; and an active time determination sub-circuit 322 configured to acquire the active data transmission time of each row of the sub-pixels, where the active data transmission time is determined based on a size and a refresh frequency of the display panel; where the active time determination sub-circuit 322 may execute step 205 in the above embodiment.

The pixel charging sub-circuit 330 is configured to charge each row of the sub-pixels according to the blank time and the active data transmission time of each row of the sub-pixels when the display panel displays any frame of the image. The pixel charging sub-circuit 330 may execute step 206 in the above embodiment.

Figure 3C:
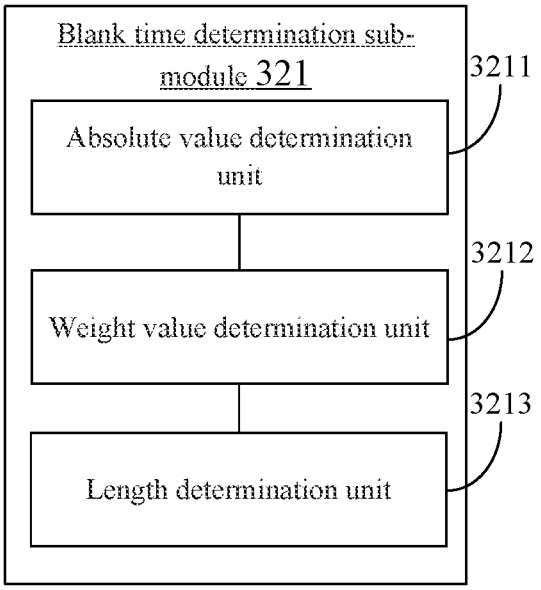
FIG. 3C is a block diagram of a blank time determination sub-circuit in the embodiment illustrated by FIG. 3A.

FIG. 3C is a block diagram of a blank time determination sub-sub-circuit in the embodiment illustrated by FIG. 3A. Optionally, as shown in FIG. 3C, the blank time determination sub-circuit 321 includes:

an absolute value determination sub-circuit 3211 configured to acquire an absolute value of the preset difference value; where the absolute value determination sub-circuit 3211 may execute step 202 in the above embodiment;

a weight value determination sub-circuit 3212 configured to determine a weight value of the n-th row of sub-pixels according to the absolute value of the preset difference value, the weight value being positively related to the absolute value of the preset difference value; where the weight value determination sub-circuit 3212 may execute step 203 in the above embodiment; and a length determination sub-circuit 3213 configured to determine a product of the weight value and a standard length of a blank time to be a blank time of the n-th row of sub-pixels, the standard length of the blank time being determined based on the size and the refresh frequency of the display panel.

Optionally, the weight value determination sub-circuit 3212 is configured to: acquire an average gray-scale difference value according to an preset equation, and the preset equation may be shown as $$P = \left(\sum_{i=2}^{h} \Delta L_i\right) \Big/ (h-1),$$

where $\Delta L_i$ represents an absolute value of a difference value between a gray-scale value of an i-th row of sub-pixels and a gray-scale value of an (i−1)-th row of sub-pixels, h represents a total number of rows of sub-pixels in the display panel, and P represents an average gray-scale difference value; and determine a quotient of the absolute value of the preset difference value and the average gray-scale difference value to be a weight value of the n-th row of sub-pixels. The length determination sub-circuit 3213 may execute steps 2031 and 2032 in the above embodiment.

Optionally, in any frame of the image, a gray-scale value of any row of sub-pixels is an average value of gray-scale values of all sub-pixels in the row of the sub-pixels.

In summary, in the pixel charging method provided by an embodiment of the present disclosure, the charging time of each row of sub-pixels is determined according to the gray-scale value of each row of the sub-pixels, so as to reduce a charging rate difference between two rows of sub-pixels which have a relatively larger gray-scale value difference therebetween, solve a problem of un-uniform charging rates of all rows of the sub-pixels in the related art, and achieve an effect of improving the uniformity of the charging rates of all rows of sub-pixels in the display panel.

Further, there is also provided a display device in the present disclosure. The display device may include the pixel charging circuit shown in FIG. 3A. The display device may be: a liquid crystal display panel, an electronic paper, an OLED panel, a mobile phone, a tablet computer, a television, a display, a laptop computer, a digital photo frame, a navigator or any other products or components with a display function.

There is further provided, in the present disclosure, a driving device for a display panel, including:

a memory configured to store program instructions; and a processor configured to invoke the program instructions stored in the memory and execute the method shown in FIG. 1 or FIG. 2A according to the obtained program instructions.

There is further provided, in the present disclosure, a computer storage medium storing computer-executable instructions which cause a computer to execute the method shown in FIG. 1 or FIG. 2A.

In some embodiments provided by the present disclosure, it should be understood that the disclosed device and method may be implemented in other ways. For example, the above-described device embodiments are merely illustrative. For instance, a division of the unit is merely a kind of logical function division. In practice, there may be other division manners during implementation. For example, multiple units or components may be combined or may be integrated into another system, or some features may be omitted or not implemented. In addition, displayed or discussed mutual coupling, direct coupling or a communication connection may be indirect coupling or a communication connection through some interfaces, devices or units, and may be in electrical, mechanical, or another manners.

The units described as separate components may be or may not be physically separated, and components displayed as units may be or may not be physical units. That is, the components can be located at one place, or distributed to multiple network units. Some or all the units may be selected to realize the principles of the embodiments according to the actual needs.

Persons of ordinary skill in the art can understand that all or part of the steps described in the above embodiments can be completed through hardware, or through relevant hardware instructed by programs stored in a non-transitory computer readable storage medium, such as read-only memory, disk or CD, etc.

The foregoing descriptions are merely some exemplary embodiments of the present disclosure, and are not intended to limit the present disclosure. Any modifications, equivalent substitutions, improvements, etc., within the spirit and principles of the disclosure, shall fall into the protection scope of the present disclosure.

What is claimed is:

1. A pixel charging method, comprising:

acquiring a gray-scale value of each row of sub-pixels in an image frame to be displayed;

determining a charging time of each row of the sub-pixels according to the gray-scale value of each row of the sub-pixels, wherein a charging time of an n-th row of the sub-pixels in the image frame is positively related to an absolute value of a difference value, the difference value is a difference value between a gray-scale value of the n-th row of the sub-pixels and a gray-scale value of an (n−1)-th row of the sub-pixels in the image frame, and n is an integer greater than 1; and charging each row of the sub-pixels according to the charging time of each row of the sub-pixels when a display panel displays the image frame.

2. The method of claim 1, wherein the charging time of each row of the sub-pixels comprises an active data transmission time for writing active data into each row of the sub-pixels and a blank time for writing blank data into each row of the sub-pixels.

3. The method of claim 2, wherein the determining the charging time of each row of the sub-pixels according to the gray-scale value of each row of the sub-pixels comprises:

determining a blank time of each row of the sub-pixels according to the gray-scale value of each row of the sub-pixels; and acquiring an active data transmission time of each row of the sub-pixels, the active data transmission time being determined based on a size and a refresh frequency of the display panel.

4. The method of claim 3, wherein the charging each row of the sub-pixels according to the charging time of each row of the sub-pixels when the display panel displays the image frame comprises:

charging each row of the sub-pixels according to the blank time and the active data transmission time of each row of the sub-pixels when the display panel displays the image frame.

5. The method of claim 3, wherein the determining the blank time of each row of the sub-pixels according to the gray-scale value of each row of the sub-pixels comprises:

acquiring an absolute value of the difference value;

determining a weight value of the n-th row of the sub-pixels according to the absolute value of the difference value, the weight value being positively related to the absolute value of the difference value; and determining a product of the weight value and a standard length of the blank time to be a blank time of the n-th row of the sub-pixels, the standard length of the blank time being determined based on the size and the refresh frequency of the display panel.

6. The method of claim 5, wherein the determining the weight value of the n-th row of the sub-pixels according to the absolute value of the preset difference value comprises:

acquiring an average gray-scale difference value according to a preset equation, and the equation is shown as $$P = \left(\sum_{i=2}^{h} \Delta L_i\right) \Big/ (h-1),$$

wherein $\Delta L_i$ represents an absolute value of a difference value between a gray-scale value of an i-th row of the sub-pixels and a gray-scale value of an (i−1)-th row of the sub-pixels, h represents a total number of rows of the sub-pixels in the display panel, P represents the average gray-scale difference value, and i may be any number greater than or equal to 2 and less than or equal to h; and determining a quotient of the absolute value of the difference value and the average gray-scale difference value to be the weight value of the n-th row of the sub-pixels.

7. The method of claim 1, wherein in the image frame, a gray-scale value of a row of sub-pixels is an average value of gray-scale values of all sub-pixels in the row of the sub-pixels.

8. A display panel driving device, comprising:

a memory, configured to store program instructions; and a processor configured to invoke the program instructions stored in the memory and execute the method of claim 1 according to the obtained program instructions.

9. A computer storage medium storing computer-executable instructions which cause a computer to execute the method of claim 1.

10. A pixel charging circuit, comprising:

a gray-scale acquisition sub-circuit, configured to acquire a gray-scale value of each row of sub-pixels in an image frame;

a time determination sub-circuit, configured to determine a charging time of each row of the sub-pixels according to the gray-scale value of each row of the sub-pixels, wherein a charging time of an n-th row of the sub-pixels in the image frame is positively related to an absolute value of a difference value, and the difference value is a difference value between a gray-scale value of the n-th row of the sub-pixels and a gray-scale value of an (n−1)-th row of the sub-pixels in the image frame, and n is an integer greater than 1; and a pixel charging sub-circuit, configured to charge each row of the sub-pixels according to the charging time of each row of the sub-pixels when a display panel displays the image frame.

11. The pixel charging circuit of claim 10, wherein the charging time of each row of the sub-pixels comprises an active data transmission time for writing active data into each row of the sub-pixels and a blank time for writing blank data into each row of the sub-pixels.

12. The pixel charging circuit of claim 11, wherein the time determination sub-circuit comprises:

a blank time determination sub-circuit, configured to determine the blank time of each row of the sub-pixels according to the gray-scale value of each row of the sub-pixels; and an active time determination sub-circuit, configured to acquire the active data transmission time of each row of the sub-pixels, the active data transmission time being determined based on a size and a refresh frequency of the display panel.

13. The pixel charging circuit of claim 12, wherein the pixel charging sub-circuit is configured to charge each row of the sub-pixels according to the blank time and the active data transmission time of each row of the sub-pixels when the display panel displays the image frame.

14. The pixel charging circuit of claim 12, wherein the blank time determination sub-sub-circuit comprises:

an absolute value determination sub-circuit, configured to acquire an absolute value of the difference value;

a weight value determination sub-circuit, configured to determine a weight value of the n-th row of sub-pixels according to the absolute value of the difference value, the weight value being positively related to the absolute value of the difference value; and a length determination sub-circuit, configured to determine a product of the weight value and a standard length of the blank time to be a blank time of the n-th row of sub-pixels, the standard length of the blank time being determined based on the size and the refresh frequency of the display panel.

15. The pixel charging circuit of claim 14, wherein the weight value determination sub-circuit is configured to:

acquire an average gray-scale difference value according to a equation, and the equation is shown as $$P = \left(\sum_{i=2}^{h} \Delta L_i\right) \Big/ (h-1),$$

wherein $\Delta L_i$ represents an absolute value of a difference value between a gray-scale value of an i-th row of the sub-pixels and a gray-scale value of an (i−1)-th row of the sub-pixels, h represents a total number of rows of the sub-pixels in the display panel, P represents the average gray-scale difference value, and i may be any number greater than or equal to 2 and less than or equal to h; and determine a quotient of the absolute value of the difference value and the average gray-scale difference value to be the weight value of the n-th row of the sub-pixels.

16. The pixel charging circuit of claim 10, wherein in the image frame, a gray-scale value of a row of sub-pixels is an average value of gray-scale values of all sub-pixels in the row of the sub-pixels.

17. A display device, comprising a pixel charging circuit, wherein the pixel charging circuit comprises:

a gray-scale acquisition sub-circuit, configured to acquire a gray-scale value of each row of sub-pixels in an image frame;

a time determination sub-circuit, configured to determine a charging time of each row of the sub-pixels according to the gray-scale value of each row of the sub-pixels, wherein a charging time of an n-th row of the sub-pixels in the image frame is positively related to an absolute value of a difference value, and the difference value is a difference value between a gray-scale value of the n-th row of the sub-pixels and a gray-scale value of an (n−1)-th row of the sub-pixels in the image frame, and n is an integer greater than 1; and a pixel charging sub-circuit, configured to charge each row of the sub-pixels according to the charging time of each row of the sub-pixels when a display panel displays the image frame.

18. The display device of claim 17, wherein the charging time of each row of the sub-pixels comprises an active data transmission time for writing active data into each row of the sub-pixels and a blank time for writing blank data into each row of the sub-pixels.

19. The display device of claim 18, wherein the time determination sub-circuit comprises:

a blank time determination sub-circuit, configured to determine the blank time of each row of the sub-pixels according to the gray-scale value of each row of the sub-pixels; and an active time determination sub-circuit, configured to acquire the active data transmission time of each row of the sub-pixels, the active data transmission time being determined based on a size and a refresh frequency of the display panel.

20. The display device of claim 19, wherein the pixel charging sub-circuit is configured to charge each row of the sub-pixels according to the blank time and the active data transmission time of each row of the sub-pixels when the display panel displays the image frame.

* * * * *